US009241398B2

(12) United States Patent
Tajima et al.

(10) Patent No.: US 9,241,398 B2
(45) Date of Patent: Jan. 19, 2016

(54) METHOD OF MANUFACTURING HIGH-FREQUENCY ACCELERATION CAVITY COMPONENT

(75) Inventors: Yujiro Tajima, Yokohama (JP); Tomoko Ota, Yokohama (JP); Junichi Shibuya, Yokohama (JP); Koichi Nakayama, Musashino (JP); Takeshi Yoshiyuki, Yokohama (JP); Yuji Nobusada, Yokohama (JP)

(73) Assignee: KABUSHIKI KAISHA TOSHIBA, Tokyo (JP)

( * ) Notice: Subject to any disclaimer, the term of this patent is extended or adjusted under 35 U.S.C. 154(b) by 797 days.

(21) Appl. No.: 13/619,291

(22) Filed: Sep. 14, 2012

(65) Prior Publication Data

US 2013/0252820 A1 Sep. 26, 2013

Related U.S. Application Data

(63) Continuation of application No. PCT/JP2011/055637, filed on Mar. 10, 2011.

(30) Foreign Application Priority Data

Mar. 25, 2010 (JP) ..... 2010-070613

(51) Int. Cl.

| | |
|---|---|
| ***B22F 3/15*** | (2006.01) |
| ***H05H 7/20*** | (2006.01) |
| ***B22F 5/06*** | (2006.01) |
| ***B21C 37/06*** | (2006.01) |
| ***B30B 11/00*** | (2006.01) |
| *B22F 5/10* | (2006.01) |

(52) U.S. Cl.

CPC ..... *H05H 7/20* (2013.01); *B21C 37/06* (2013.01); *B22F 5/06* (2013.01); *B30B 11/001* (2013.01); *B22F 2005/103* (2013.01)

(58) Field of Classification Search

CPC ..... H05H 7/20

See application file for complete search history.

(56) References Cited

U.S. PATENT DOCUMENTS 1,261,543 A * 4/1918 Meyerhoff ..... B29C 45/374 249/103
3,687,823 A * 8/1972 Lugscheider et al. ... B23K 3/08 205/122

(Continued)

FOREIGN PATENT DOCUMENTS

JP 56-144884 11/1981
JP 62-252099 11/1987

(Continued)

OTHER PUBLICATIONS

International Search Report dated Apr. 12, 2011, issued for International Application No. PCT/JP2011/055637, filed Mar. 10, 2011 (w/English Translation).

(Continued)

*Primary Examiner* — George Wyszomierski
*Assistant Examiner* — Ngoclan T Mai
(74) *Attorney, Agent, or Firm* — Oblon, McClelland, Maier & Neustadt, L.L.P.

(57) ABSTRACT

According to one embodiment, there is provided a method of manufacturing a high-frequency acceleration cavity component, the method including covering a mold with a conducting material, enclosing, in an outer shell, the mold covered with the conducting material, vacuum-airtight-welding the outer shell enclosing the mold, conducing hot isostatic pressing of the vacuum-airtight-welded outer shell, and taking the conducting material formed in the mold out of the outer shell which has undergone the hot isostatic pressing.

13 Claims, 12 Drawing Sheets

(56) References Cited

U.S. PATENT DOCUMENTS

| | | | | |
|---|---|---|---|---|
| 4,012,293 | A * | 3/1977 | Meyerhoff | C23D 1/02 205/230 |
| 5,445,787 | A * | 8/1995 | Friedman | B22F 3/20 419/26 |
| 7,332,123 | B2 * | 2/2008 | Jackson | B22F 5/10 148/422 |
| 2010/0066273 | A1 | 3/2010 | Saito et al. | |

FOREIGN PATENT DOCUMENTS

| | | |
|---|---|---|
| JP | 6-256869 | 9/1994 |
| JP | 7-272965 | 10/1995 |
| JP | 2000-306697 | 11/2000 |
| JP | 2001-143898 | 5/2001 |
| JP | 2002-367799 | 12/2002 |
| JP | 2009-135049 A | 6/2009 |
| WO | WO 2006-129602 A1 | 12/2006 |

OTHER PUBLICATIONS

International Written Opinion dated Apr. 12, 2011, issued for International Application No. PCT/JP2011/055637, filed Mar. 10, 2011 (w/English Translation).

International Preliminary Report on Patentability issued Oct. 11, 2012 in PCT/JP2011/055637 filed Mar. 10, 2011.

Written Opinion issued Apr. 12, 2011 in PCT/JP2011/055637 filed Mar. 10, 2011 submitting English translation only.

* cited by examiner

METHOD OF MANUFACTURING HIGH-FREQUENCY ACCELERATION CAVITY COMPONENT

CROSS REFERENCE TO RELATED APPLICATIONS

This application is a Continuation Application of PCT Application No. PCT/JP2011/055637, filed Mar. 10, 2011 and based upon and claiming the benefit of priority from Japanese Patent Application No. 2010-070613, filed Mar. 25, 2010, the entire contents of all of which are incorporated herein by reference.

FIELD

Embodiments described herein relate generally to a method of manufacturing a high-frequency acceleration cavity component for use in an accelerator which accelerates charged particles by high-frequency waves.

BACKGROUND

In general, an accelerator is a device which uses an electromagnetic field to accelerate charged particles such as electrons, protons, or ions to a high-energy state at approximately a maximum of several trillion electron volts (several TeV). The accelerator was originally developed for the studies of atomic nuclei and elementary particles. Recently, the application of the accelerator has been extended to a wide range of scientific and technical fields including, for example, very large scale integrated circuits (LSI), microfabrication (lithography), substance studies, and life sciences by using emitted light (referred to as synchrotron orbital radiation (SOR) light) which is generated by the accelerator. When the orbit of electrons propagating in a vacuum substantially at light velocity is bent by a deflecting magnetic field, the emitted light is generated in the tangential direction of the orbit.

The accelerator thus applied in the wide range has a high-frequency acceleration cavity provided at the beam line of a charged particle beam to supplement energy lost for the acceleration of charged particles or lost as the SOR light.

The high-frequency waves fed into the high-frequency acceleration cavity oscillate, and a high electric field is thereby generated. The charged particle beam is accelerated by the high electric field. When the high electric field is thus generated, a circulating current passes through the inner surface of the high-frequency acceleration cavity. This circulating current is a high-frequency current, and therefore runs at a skin depth corresponding to the material of the inner surface of the high-frequency acceleration cavity. As a result, the circulating current leads to Joule loss.

This Joule loss becomes considerable if a high electric field necessary for the acceleration of the charged particle beam is obtained in a normal conducting high-frequency acceleration cavity made of oxygen-free copper or aluminum. A high-power high-frequency oscillator capable of feeding a great amount of high-frequency power is needed to compensate for the Joule loss. However, the output of the high-frequency oscillator is limited, and there are many problems in cooling the high-frequency acceleration cavity which has been heated by the Joule loss. Thus, the application of the normal conducting high-frequency acceleration cavity is limited.

Accordingly, it is known to manufacture a high-frequency acceleration cavity by using a superconducting material much lower in radio-frequency resistance than a normal conducting material in order to reduce a current running through the inner surface of the high-frequency acceleration cavity (see, e.g., Jpn. Pat. Appln. KOKAI Publication No. 2009-135049).

This superconducting high-frequency acceleration cavity is used in various fields. For example, an electron beam accelerator is coming into practical use for an X-ray free electron laser which has recently been constructed in Germany or for international linear colliders which have recently been developed all over the world. Thus, the superconducting high-frequency acceleration cavity is used to obtain electrons having the highest possible energy within the range of limited power and limited space.

However, welding is often used to manufacture such a superconducting high-frequency acceleration cavity. Weld-sputtering of the inner surface of the cavity and the inclusion of an impurity during welding increase the Joule loss, and limit the performance of the high-frequency acceleration cavity. It is therefore preferable to minimize welded portions. One method of manufacturing a superconducting high-frequency acceleration cavity by welding is to weld and thereby bond a plurality of bowl-like superconducting materials which are formed from a plate material, for example, by deep drawing.

In the meantime, one (seamless) manufacturing method that eliminates the welded portions can be to process a cylinder made of a superconducting material into the form of a cavity, for example, by hydraulic molding. Here, one way chosen to create a cylinder is to either round plates and weld the abutted ends of the plates or chip a bulk material. However, the manufacturing method that rounds the plates cannot eliminate the welded portions. The manufacturing method that chips the bulk material, on the other hand, produces a great amount of chips and leads to a cost rise.

DETAILED DESCRIPTION

In general, according to one embodiment, there is provided a method of manufacturing a high-frequency acceleration cavity component. The method includes covering a mold with a conducting material; enclosing, in an outer shell, the mold covered with the conducting material; vacuum-airtight-welding the outer shell enclosing the mold; conducing hot isostatic pressing of the vacuum-airtight-welded outer shell; and taking the conducting material formed in the mold out of the outer shell which has undergone the hot isostatic pressing.

Hereinafter, embodiments will be described with reference to the drawings.

First Embodiment

Processes of a method of manufacturing a superconducting high-frequency acceleration cavity according to the first embodiment are described with reference to FIG. 1 to FIG. 7. Like parts are provided with like reference marks throughout the drawings and are not repeatedly explained in detail, and differences are mainly described. Repeated explanations are also omitted in the embodiments that follow.

Figure 1:
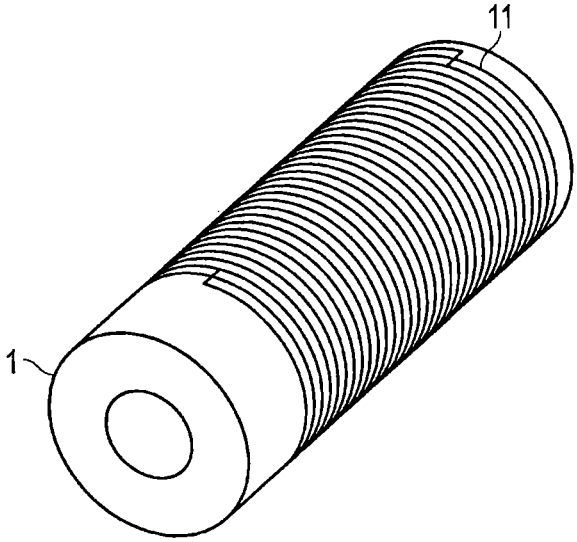
FIG. 1 is a perspective view showing an aluminum shaft around which niobium thin films according to a first embodiment is wound.
Figure 2:
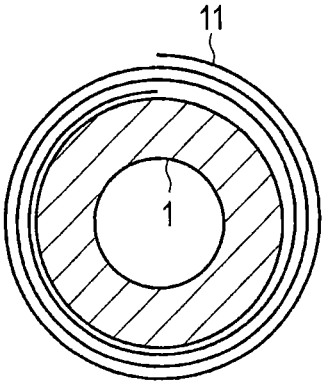
FIG. 2 is a sectional view of the aluminum shaft around which the niobium thin films according to the first embodiment are wound, wherein the upper part of the surface cut perpendicularly to the longitudinal direction is shown.
Figure 3:
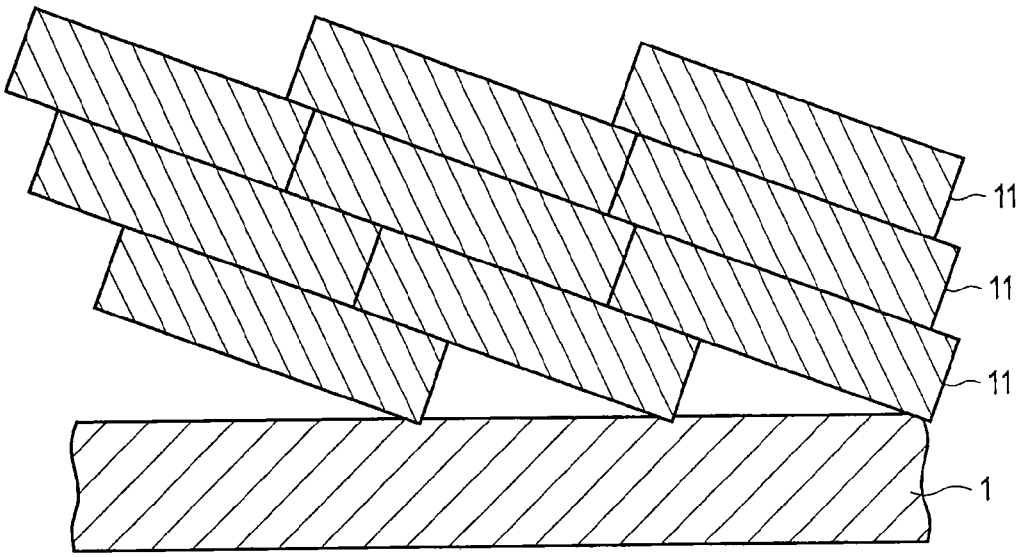
FIG. 3 is a sectional view of the aluminum shaft around which the niobium thin films according to the first embodiment are wound, wherein the upper part of the surface cut in the longitudinal direction is shown.

FIG. 1 is a perspective view showing an aluminum shaft 1 around which niobium thin films 11 are wound. FIG. 2 is a sectional view of the aluminum shaft 1 around which the niobium thin films 11 are wound, wherein the surface cut perpendicularly to the longitudinal direction is shown. FIG. 3 is a sectional view of the aluminum shaft 1 around which the niobium thin films 11 are wound, wherein the upper part of the surface cut in the longitudinal direction is shown.

The aluminum shaft 1 is an aluminum shaft having an outside diameter of approximately 70 mm and a thickness of approximately 10 mm.

The niobium thin film 11 is a ribbon-like (or tape-like) niobium thin film having a thickness of approximately 1 mm or less and a width of approximately 10 mm or less. Niobium is a superconducting material. Although the proper thickness is approximately 1 mm to approximately 10 μm in practice, the thickness can be as small as possible.

As shown in FIG. 1 and FIG. 2, an operator winds the niobium thin films 11 around the aluminum shaft 1. In this case, as shown in FIG. 3, the niobium thin films 11 are wound slightly over one another without any clearance between the adjacent niobium thin films 11. The operator stacks the niobium thin films 11 on the aluminum shaft 1 to reach a thickness of approximately 5 mm.

Figure 4:
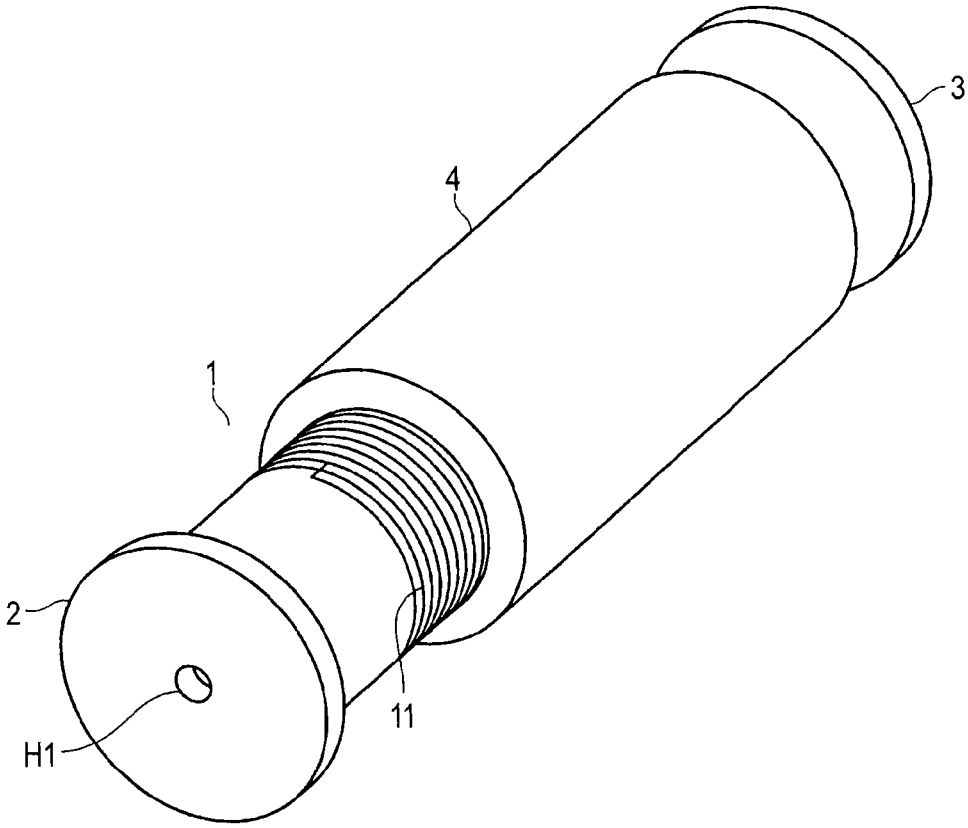
FIG. 4 is a perspective view showing how the aluminum shaft around which the niobium thin films according to the first embodiment are wound is inserted into an aluminum capsule.

FIG. 4 is a perspective view showing how the aluminum shaft 1 around which the niobium thin films 11 are wound is inserted into an aluminum capsule 4.

The aluminum capsule 4 is a cylindrical aluminum outer shell having an inside diameter of approximately 80 mm and a thickness of approximately 10 mm. Aluminum end plates 2 and 3 are disk-like aluminum end plates having a thickness of approximately 10 mm. The aluminum end plate 2 is provided with a vacuum drawing hole H1.

The operator inserts, into the aluminum capsule 4, the aluminum shaft 1 around which the niobium thin films 11 are wound. After inserting the aluminum shaft 1 into the aluminum capsule 4, the operator attaches the aluminum end plates 2 and 3 to block both ends of the aluminum capsule 4.

Figure 5:
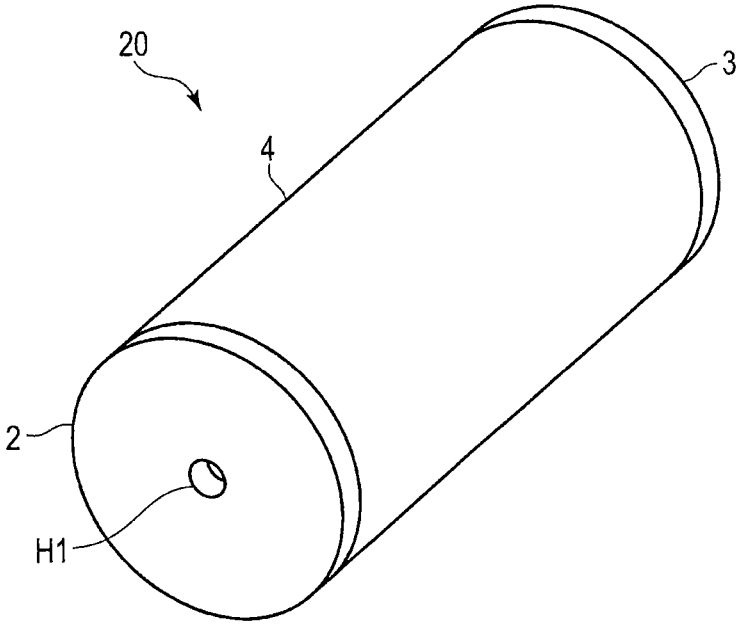
FIG. 5 is a perspective view showing the condition of a work in a process prior to an HIP process according to the first embodiment.

FIG. 5 is a perspective view showing the condition of a work 20 in a process prior to a hot isostatic pressing process (hereinafter referred to as an "HIP process").

After attaching the aluminum end plates 2 and 3 to the aluminum capsule 4, the operator vacuum-airtight-welds the aluminum capsule 4 and the aluminum end plates 2 and 3, and then vacuum-pumps (draws a vacuum in) the inside of the capsule through the vacuum drawing hole H1. The operator places the aluminum capsule 4 enclosing the aluminum shaft 1 around which the niobium thin films 11 are wound, in an HIP furnace as the work 20 for the HIP process. The operator HIP-processes the work 20 by superheating and gaseous argon pressurization.

Figure 6:
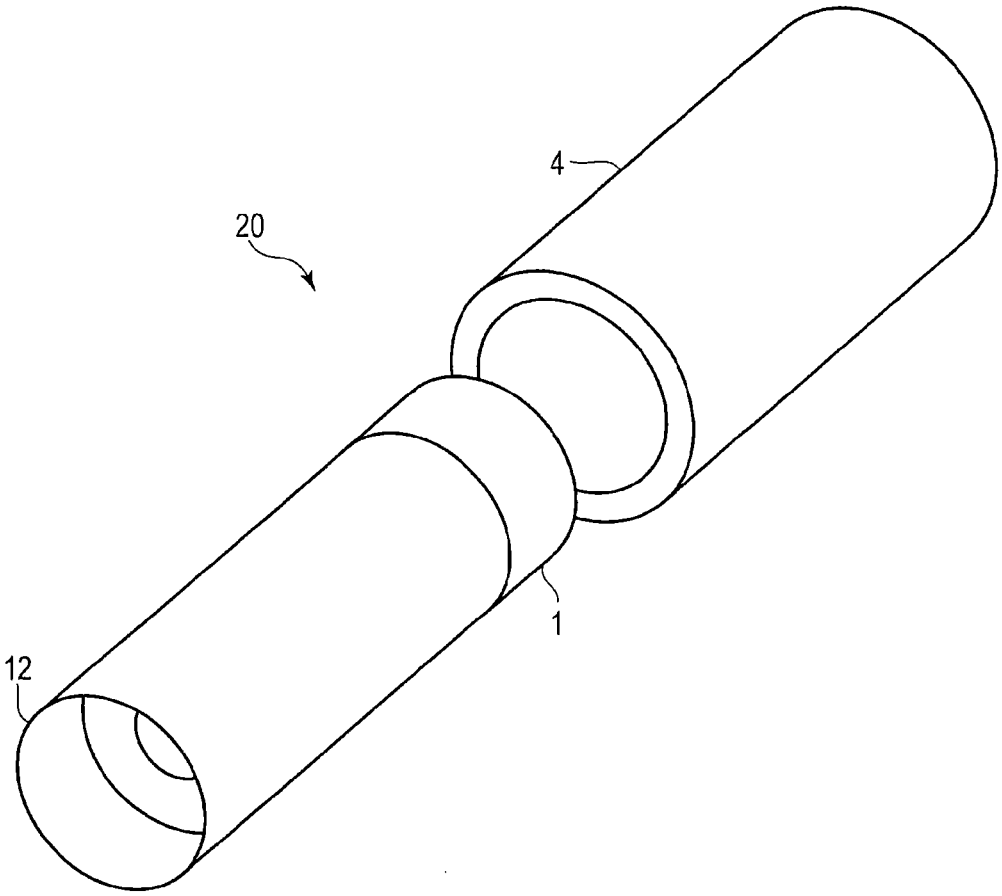
FIG. 6 is a perspective view showing how the work is taken out in a process subsequent to the HIP process according to the first embodiment.

FIG. 6 is a perspective view showing how the work 20 is taken out in a process subsequent to the HIP process.

After the HIP process, the operator takes the work 20 out of the HIP furnace. The operator removes the aluminum end plates 2 and 3 of the taken capsule-like work 20 by machining. The operator then takes, out of the work 20, the aluminum shaft 1 around which a pipe-like work 12 having the niobium thin films 11 formed therein is wound. The operator removes the aluminum shaft 1 from the niobium work 12 by machining.

Figure 7:
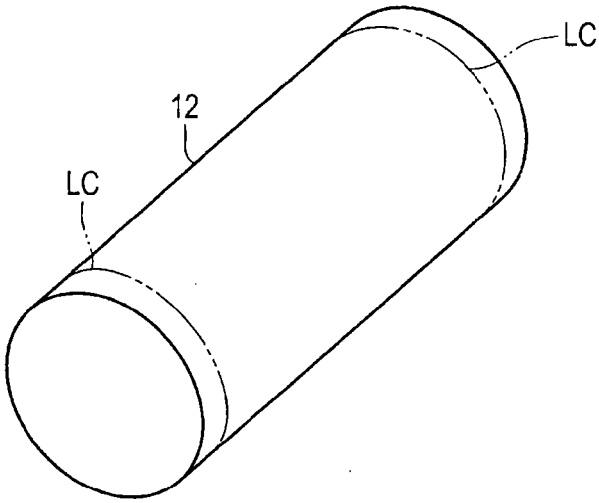
FIG. 7 is a perspective view showing how the niobium work after the HIP process is worked according to the first embodiment.

FIG. 7 is a perspective view showing how the niobium work 12 after the HIP process is worked.

The operator cuts both ends of the taken niobium work 12 (niobium cylinder) along cut lines LC shown in FIG. 7, and thus finishes the end faces.

The operator polishes the niobium cylinder to approximately submicron surface roughness.

The operator uses the manufactured niobium cylinder as a component to constitute a cavity, thereby manufacturing a superconducting high-frequency acceleration cavity.

According to the present embodiment, the niobium thin films 11 which are a cylindrical material for use in the superconducting high-frequency acceleration cavity are wound around the aluminum shaft 1 and diffusion-bonded. The aluminum shaft 1 is then pulled from the diffusion-bonded niobium thin films 11, and a desired cylinder can thereby be manufactured. As the cylindrical niobium thin films 11 thus manufactured are diffusion-bonded, a manufactured cylinder has a uniform crystal grain boundary. Moreover, this cylinder is not welded in its manufacturing process, so that this cylinder has no welded traces.

All the niobium thin films 11 are bonded together to form a cylinder. It is therefore possible to minimize the use of the niobium thin films 11 which are the materials to manufacture the cylinder.

Furthermore, a cylinder having any thickness can be manufactured by selecting any number of the niobium thin films 11 to be wound around the aluminum shaft 1.

Accordingly, it is possible to manufacture a superconducting cylinder having a uniform crystal grain boundary and having no welded traces as described above. If this cylinder is applied to a superconducting high-frequency acceleration cavity, this superconducting high-frequency acceleration cavity can have reduced welded parts. The superconducting high-frequency acceleration cavity is therefore of high quality and capable of generating a high electric field. According to this manufacturing method, it is possible to manufacture a superconducting high-frequency acceleration cavity with reduced welding operation cost and material cost. Moreover, according to this manufacturing method, it is possible to manufacture a superconducting high-frequency acceleration cavity having any thickness.

Modification of First Embodiment

A manufacturing method according to the present modification uses a ceramic shaft instead of the aluminum shaft 1.

When removing the shaft (the shaft equivalent to the aluminum shaft 1) from the niobium work 12, the operator smashes this shaft.

According to the present modification, even when it is difficult to pull the shaft from the niobium work 12 after HIP bonding, the shaft can be smashed and thereby easily removed.

Second Embodiment

A method of manufacturing a superconducting high-frequency acceleration cavity according to the second embodiment is described with reference to FIG. 8 and FIG. 9.

Figure 8:
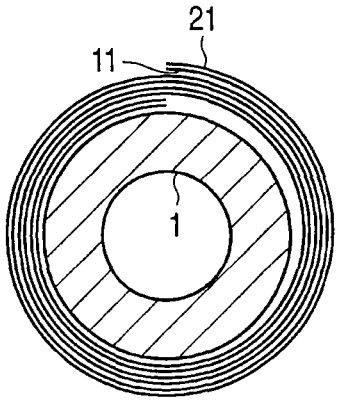
FIG. 8 is a sectional view of the aluminum shaft around which niobium thin films and tin thin films according to a second embodiment are wound, wherein the surface cut perpendicularly to the longitudinal direction is shown.
Figure 9:
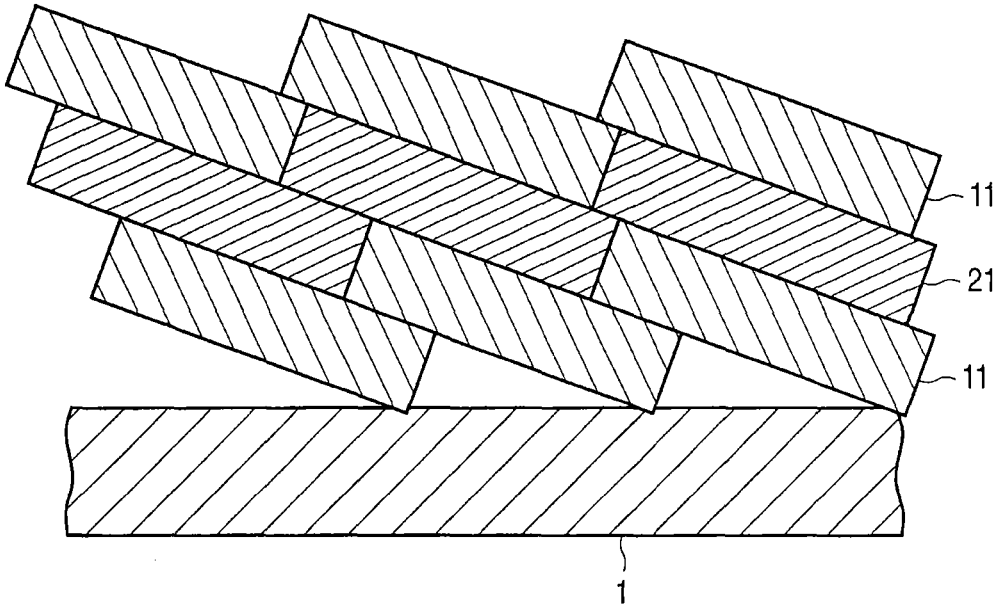
FIG. 9 is a sectional view of the aluminum shaft around which the niobium thin films and the tin thin films according to the second embodiment are wound, wherein the upper part of the surface cut in the longitudinal direction is shown.

In the method of manufacturing the superconducting high-frequency acceleration cavity according to the present embodiment, the step of winding the niobium thin films 11 around the aluminum shaft 1 in the method of manufacturing the superconducting high-frequency acceleration cavity according to the first embodiment shown in FIG. 2 and FIG. 3 is replaced by the step of winding the niobium thin films 11 and tin thin films 21 around the aluminum shaft 1 shown in FIG. 8 and FIG. 9. Other steps are similar to those in the manufacturing method according to the first embodiment and are therefore not described accordingly. Repeated explanations are also omitted in the embodiments that follow.

FIG. 8 is a sectional view of the aluminum shaft 1 around which the niobium thin films 11 and the tin thin films 21 are wound, wherein the surface cut perpendicularly to the longitudinal direction is shown. FIG. 9 is a sectional view of the aluminum shaft 1 around which the niobium thin films 11 and the tin thin films 21 are wound, wherein the upper part of the surface cut in the longitudinal direction is shown.

The tin thin film 21 is a ribbon-like (or tape-like) tin thin film similar to the niobium thin film 11.

As shown in FIG. 8, the operator winds the niobium thin films 11 and the tin thin films 21 around the aluminum shaft 1 alternately over one another. In this case, as shown in FIG. 9, the niobium thin films 11 are wound slightly over one another without any clearance between the adjacent niobium thin films 11. Similarly, the tin thin films 21 are wound slightly over one another without any clearance between the adjacent tin thin films 21. The operator stacks the niobium thin films 11 and the tin thin films 21 on the aluminum shaft 1 to reach a thickness of approximately 5 mm.

The niobium thin films 11 and the tin thin films 21 wound around the aluminum shaft 1 are HIP-processed, and an Nb3Sn cylinder can thereby be produced.

The operator polishes the Nb3Sn cylinder to approximately submicron surface roughness.

The operator uses the polished Nb3Sn cylinder as a component to constitute a cavity, thereby manufacturing a superconducting high-frequency acceleration cavity.

According to the present embodiment, it is possible to obtain the following advantageous effects in addition to advantageous effects similar to those according to the first embodiment.

Nb3Sn has a high superconducting critical temperature and a small magnetic penetration depth, and is therefore more advantageous as the material of the superconducting high-frequency acceleration cavity than niobium. The manufacturing method according to the present embodiment makes it possible to manufacture a superconducting high-frequency acceleration cavity made of Nb3Sn which is more advantageous as the material of the superconducting high-frequency acceleration cavity than niobium.

As any thickness of the Nb3Sn cylinder can be selected, a cylinder having submicron order surface roughness can be formed by polishing. This cylinder can be used to manufacture a higher-performance superconducting high-frequency acceleration cavity.

In contrast, for example, Sn is evaporated onto a niobium substrate formed into a cavity form, and diffusion-bonded to manufacture a superconducting high-frequency acceleration cavity. In this case, Nb3Sn to be formed is a thin layer of several ten microns and therefore cannot be polished.

Third Embodiment

A method of manufacturing a superconducting high-frequency acceleration cavity according to the third embodiment is described with reference to FIG. 10 and FIG. 11.

Figure 10:
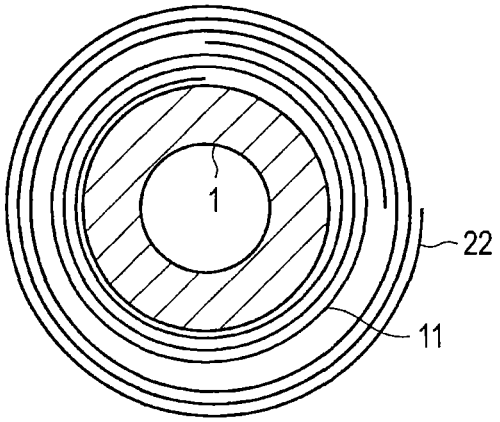
FIG. 10 is a sectional view of the aluminum shaft around which niobium thin films and copper thin films according to a third embodiment are wound, wherein the surface cut perpendicularly to the longitudinal direction is shown.
Figure 11:
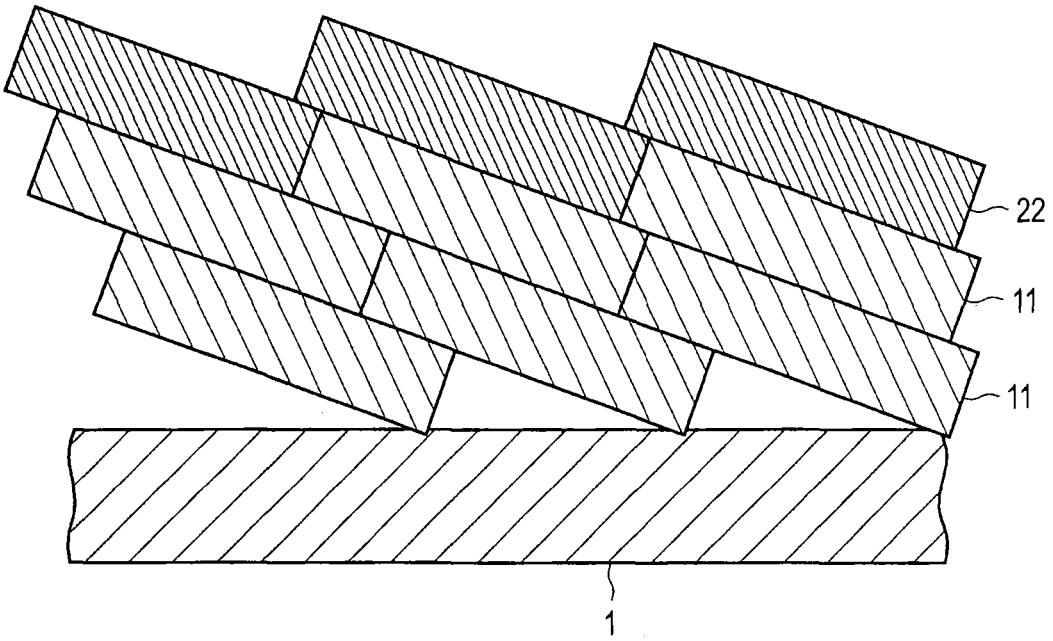
FIG. 11 is a sectional view of the aluminum shaft around which the niobium thin films and the copper thin films according to the third embodiment are wound, wherein the upper part of the surface cut in the longitudinal direction is shown.

In the method of manufacturing the superconducting high-frequency acceleration cavity according to the present embodiment, the step of winding the niobium thin films 11 around the aluminum shaft 1 in the method of manufacturing the superconducting high-frequency acceleration cavity according to the first embodiment shown in FIG. 2 and FIG. 3 is replaced by the step of winding the niobium thin films 11 and copper thin films 22 around the aluminum shaft 1 shown in FIG. 10 and FIG. 11. Other steps are similar to those in the manufacturing method according to the first embodiment.

FIG. 10 is a sectional view of the aluminum shaft 1 around which the niobium thin films 11 and the copper thin films 22 are wound, wherein the surface cut perpendicularly to the longitudinal direction is shown. FIG. 11 is a sectional view of the aluminum shaft 1 around which the niobium thin films 11 and the copper thin films 22 are wound, wherein the upper part of the surface cut in the longitudinal direction is shown.

The copper thin film 22 is a ribbon-like (or tape-like) copper thin film similar to the niobium thin film 11.

As shown in FIG. 10, the operator first winds the niobium thin films 11 around the aluminum shaft 1. In this case, as shown in FIG. 11, the niobium thin films 11 are wound slightly over one another without any clearance between the adjacent niobium thin films 11. The operator stacks the niobium thin films 11 on the aluminum shaft 1 to reach a thickness of approximately 5 mm.

As shown in FIG. 10, the operator then additionally winds the copper thin films 22 around the aluminum shaft 1 over the wound niobium thin films 11. In this case, as shown in FIG. 11, the copper thin films 22 are wound slightly over one another without any clearance between the adjacent copper thin films 22. As a result, the copper thin films 22 are wound on the outermost side of the aluminum shaft 1.

The niobium thin films 11 and the copper thin films 22 thus wound around the aluminum shaft 1 are HIP-processed, and a copper-niobium-clad material cylinder can thereby be produced.

The operator polishes the copper-niobium-clad material cylinder to approximately submicron surface roughness.

The operator uses the polished copper-niobium-clad material cylinder as a component to constitute a cavity, thereby manufacturing a superconducting high-frequency acceleration cavity.

According to the present embodiment, it is possible to obtain the following advantageous effects in addition to advantageous effects similar to those according to the first embodiment.

The superconducting high-frequency acceleration cavity made of a superconducting material alone generates a great amount of Joule heat. Copper, on the other hand, is high in thermal conductivity. Thus, Joule heat can be efficiently released by using, as the material of the superconducting high-frequency acceleration cavity, the copper-niobium-clad material in which niobium as the superconducting material is bonded to the inner surface of copper high in thermal conductivity.

The manufacturing method according to the present embodiment makes it possible to manufacture a superconducting high-frequency acceleration cavity made of the copper-niobium-clad material which is more advantageous as the material of the superconducting high-frequency acceleration cavity than niobium.

As any thickness of the copper-niobium-clad material cylinder can be selected, a cylinder having submicron order surface roughness can be formed by polishing. This cylinder can be used to manufacture a higher-performance superconducting high-frequency acceleration cavity.

In contrast, it is possible to, for example, bond niobium to the inner surface of a copper cylinder by vapor deposition or explosive bonding and manufacture a clad material cylinder. However, in the case of the vapor deposition, the niobium layer is thin as with Nb3Sn produced by the vapor deposition described in the second embodiment, and therefore cannot be polished. In the case of the explosive bonding, the amount of heat input is small, and copper and niobium are not sufficiently diffusion-bonded.

Fourth Embodiment

A method of manufacturing a superconducting high-frequency acceleration cavity according to the fourth embodiment is described with reference to FIG. 12.

In the method of manufacturing the superconducting high-frequency acceleration cavity according to the present embodiment, niobium wires 11A are used instead of the niobium thin films 11 in the method of manufacturing the superconducting high-frequency acceleration cavity according to the first embodiment. The present embodiment is similar to the first embodiment in other respects.

Figure 12:
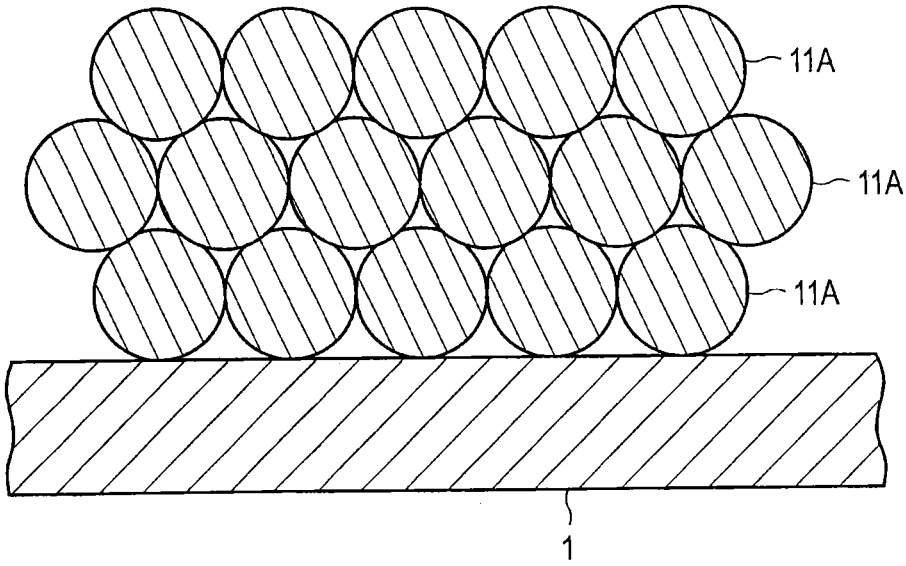
FIG. 12 is a sectional view of the aluminum shaft around which niobium wires according to a fourth embodiment are wound, wherein the upper part of the surface cut in the longitudinal direction is shown.

FIG. 12 is a sectional view of the aluminum shaft 1 around which the niobium wires 11A are wound, wherein the upper part of the surface cut in the longitudinal direction is shown.

The niobium wire 11A has a thickness of approximately 1 mm or less in diameter. The thickness may be as small as possible.

As shown in FIG. 12, the operator winds the niobium wires 11A around the aluminum shaft 1. In this case, the niobium wires 11A are wound in close contact without any clearance between the adjacent niobium wires 11A. The niobium wire 11A is wound to pass on the part between the already wound adjacent two niobium wires 11A laid one step down. The operator stacks the niobium wires 11A on the aluminum shaft 1 to reach a thickness of approximately 5 mm.

The niobium wires 11A wound around the aluminum shaft 1 are HIP-processed, and a niobium cylinder can thereby be produced.

According to the present embodiment, it is possible to obtain advantageous effects similar to those according to the first embodiment by use of the niobium wires 11A.

Fifth Embodiment

A method of manufacturing a superconducting high-frequency acceleration cavity according to the fifth embodiment is described with reference to FIG. 13.

In the method of manufacturing the superconducting high-frequency acceleration cavity according to the present embodiment, the niobium wires 11A according to the fourth embodiment are used instead of the niobium thin films 11, and tin wires 21A are used instead of the tin thin films 21 in the method of manufacturing the superconducting high-frequency acceleration cavity according to the second embodiment. The present embodiment is similar to the second embodiment in other respects.

Figure 13:
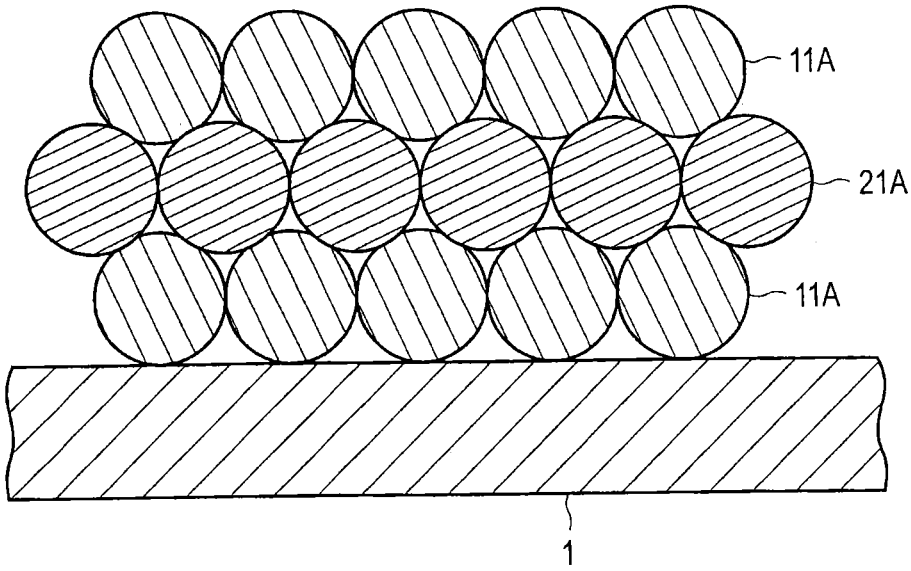
FIG. 13 is a sectional view of the aluminum shaft around which niobium wires and tin wires according to a fifth embodiment are wound, wherein the upper part of the surface cut in the longitudinal direction is shown.

FIG. 13 is a sectional view of the aluminum shaft 1 around which the niobium wires 11A and the tin wires 21A are wound, wherein the upper part of the surface cut in the longitudinal direction is shown.

The tin wire 21A has a thickness of approximately 1 mm or less in diameter. The thickness may be as small as possible.

As shown in FIG. 13, the operator winds the niobium wires 11A and the tin wires 21A around the aluminum shaft 1 alternately over one another.

The niobium wires 11A are first wound around the aluminum shaft 1. The tin wire 21A is then wound to pass on the part between the already wound adjacent two niobium wires 11A laid one step down. The niobium wire 11A is further wound to pass on the part between the already wound adjacent two tin wires 21A laid one step down. The operator thus repeats the winding of the niobium wires 11A and the tin wires 21A.

In this case, the niobium wires 11A are wound in close contact without any clearance between the adjacent niobium wires 11A. Similarly, the tin wires 21A are wound in close contact between the adjacent tin wires 21A.

The operator stacks the niobium wires 11A and the tin wires 21A on the aluminum shaft 1 to reach a thickness of approximately 5 mm.

The niobium wires 11A and the tin wires 21A wound around the aluminum shaft 1 are HIP-processed, and an Nb3Sn cylinder can thereby be produced.

According to the present embodiment, it is possible to obtain advantageous effects similar to those according to the second embodiment by use of the niobium wires 11A and the tin wires 21A.

Sixth Embodiment

A method of manufacturing a superconducting high-frequency acceleration cavity according to the sixth embodiment is described with reference to FIG. 14.

In the method of manufacturing the superconducting high-frequency acceleration cavity according to the present embodiment, the niobium wires 11A according to the fourth embodiment are used instead of the niobium thin films 11, and copper wires 22A are used instead of the copper thin films 22 in the method of manufacturing the superconducting high-frequency acceleration cavity according to the third embodiment. The present embodiment is similar to the third embodiment in other respects.

Figure 14:
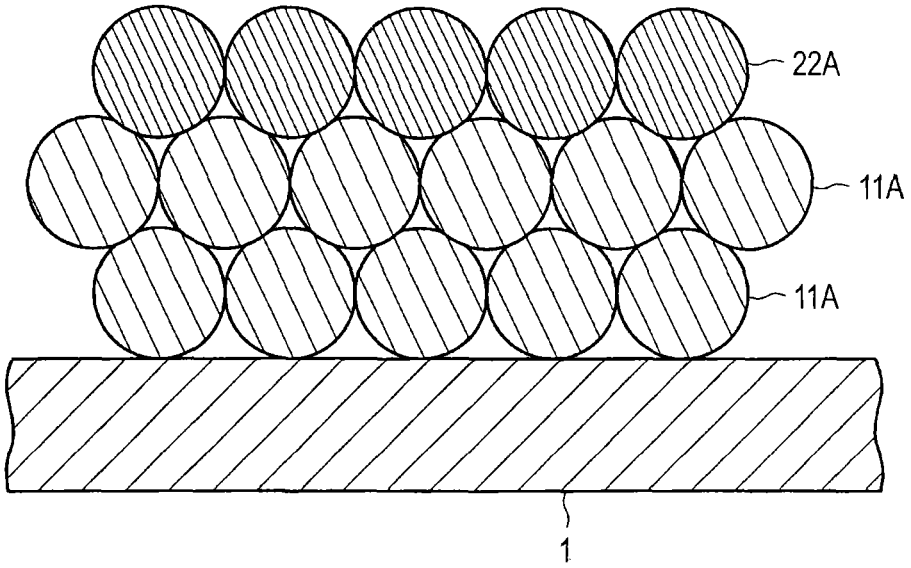
FIG. 14 is a sectional view of the aluminum shaft around which niobium wires and copper wires according to a sixth embodiment are wound, wherein the upper part of the surface cut in the longitudinal direction is shown.

FIG. 14 is a sectional view of the aluminum shaft 1 around which the niobium wires 11A and the copper wires 22A are wound, wherein the upper part of the surface cut in the longitudinal direction is shown.

The copper wire 22A has a thickness of approximately 1 mm or less in diameter. The thickness may be as small as possible.

As shown in FIG. 14, the operator first winds the niobium wires 11A around the aluminum shaft 1. In this case, the niobium wires 11A are wound in close contact without any clearance between the adjacent niobium wires 11A. Moreover, the niobium wires 11A are wound to pass on the part between the already wound adjacent two niobium wires 11A laid one step down. The operator stacks niobium wires 11A on the aluminum shaft 1 to reach a thickness of approximately 5 mm.

As shown in FIG. 14, the operator then additionally winds the copper wires 22A around the aluminum shaft 1 over the wound niobium wires 11A. In this case, the copper wires 22A are wound in close contact without any clearance between the adjacent copper wires 22A. As a result, the copper wires 22A are wound on the outermost side of the aluminum shaft 1.

The niobium wires 11A and the copper wires 22A wound around the aluminum shaft 1 are HIP-processed, and a copper-niobium-clad material cylinder can thereby be produced.

According to the present embodiment, it is possible to obtain advantageous effects similar to those according to the third embodiment by use of the niobium wires 11A and the copper wires 22A.

Seventh Embodiment

A method of manufacturing a superconducting high-frequency acceleration cavity according to the seventh embodiment is described with reference to FIG. 15.

In the method of manufacturing the superconducting high-frequency acceleration cavity according to the present embodiment, the tin wires 21A according to the fifth embodiment are used instead of the tin thin films 21 in the method of manufacturing the superconducting high-frequency acceleration cavity according to the second embodiment. The present embodiment is similar to the second embodiment in other respects.

Figure 15:
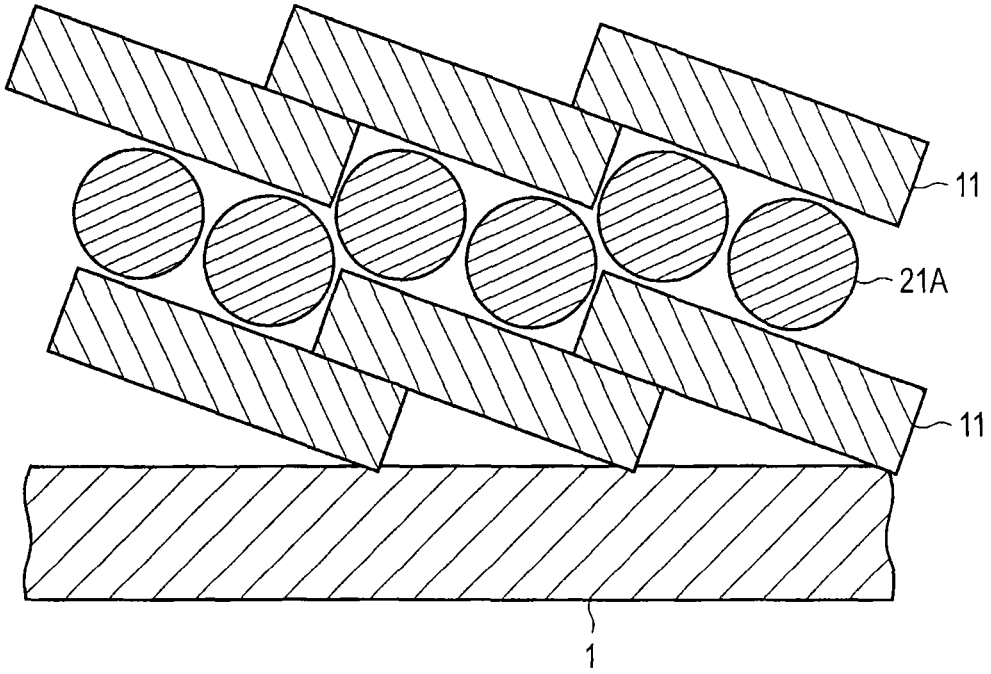
FIG. 15 is a sectional view of the aluminum shaft around which niobium thin films and tin wires according to a seventh embodiment are wound, wherein the upper part of the surface cut in the longitudinal direction is shown.

FIG. 15 is a sectional view of the aluminum shaft 1 around which the niobium thin films 11 and the tin wires 21A are wound, wherein the upper part of the surface cut in the longitudinal direction is shown.

As shown in FIG. 15, the operator winds the niobium thin films 11 and the tin wires 21A around the aluminum shaft 1 alternately over one another.

In this case, the niobium thin films 11 are wound slightly over one another without any clearance between the adjacent niobium thin films 11. The tin wires 21A are wound so that the adjacent tin wires 21A are located in proximity to each other.

The operator stacks the niobium thin films 11 and the tin wires 21A on the aluminum shaft 1 to reach a thickness of approximately 5 mm.

The niobium thin films 11 and the tin wires 21A wound around the aluminum shaft 1 are HIP-processed, and an Nb3Sn cylinder can thereby be produced.

According to the present embodiment, it is possible to obtain advantageous effects similar to those according to the second embodiment by use of the niobium thin films 11 and the tin wires 21A.

Eighth Embodiment

A method of manufacturing a superconducting high-frequency acceleration cavity according to the eighth embodiment is described with reference to FIG. 16.

In the method of manufacturing the superconducting high-frequency acceleration cavity according to the present embodiment, the copper wires 22A according to the sixth embodiment are used instead of the copper thin films 22 in the method of manufacturing the superconducting high-frequency acceleration cavity according to the third embodiment. The present embodiment is similar to the third embodiment in other respects.

Figure 16:
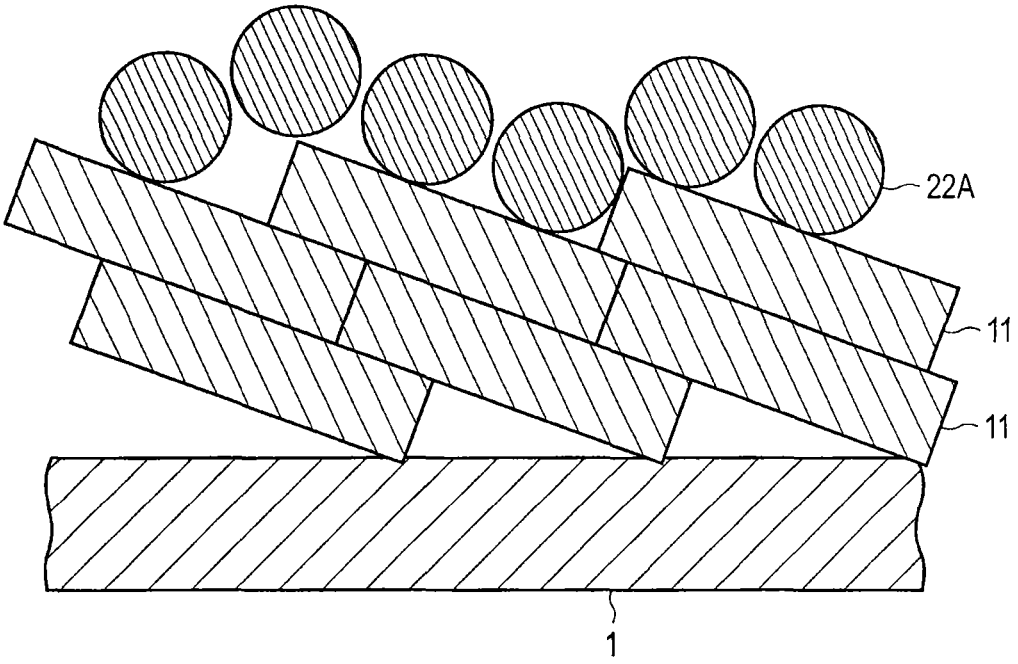
FIG. 16 is a sectional view of the aluminum shaft around which niobium thin films and copper wires according to an eighth embodiment are wound, wherein the upper part of the surface cut in the longitudinal direction is shown.

FIG. 16 is a sectional view of the aluminum shaft 1 around which the niobium thin films 11 and the copper wires 22A are wound, wherein the upper part of the surface cut in the longitudinal direction is shown.

As shown in FIG. 16, the operator first winds the niobium thin films 11 around the aluminum shaft 1. In this case, the niobium thin films 11 are wound slightly over one another without any clearance between the adjacent niobium thin films 11. The operator stacks the niobium thin films 11 on the aluminum shaft 1 to reach a thickness of approximately 5 mm.

As shown in FIG. 16, the operator then additionally winds the copper wires 22A around the aluminum shaft 1 over the wound niobium thin films 11. In this case, the copper wires 22A are wound so that the adjacent copper wires 22A are located in proximity to each other. As a result, the copper wires 22A are wound on the outermost side of the aluminum shaft 1.

The niobium thin films 11 and the copper wires 22A wound around the aluminum shaft 1 are HIP-processed, and a copper-niobium-clad material cylinder can thereby be produced.

According to the present embodiment, it is possible to obtain advantageous effects similar to those according to the third embodiment by use of the niobium thin films 11 and the copper wires 22A.

Ninth Embodiment

A method of manufacturing a superconducting high-frequency acceleration cavity according to the ninth embodiment is described with reference to FIG. 17.

In the method of manufacturing the superconducting high-frequency acceleration cavity according to the present embodiment, the niobium wires 11A according to the fourth embodiment are used instead of the niobium thin films 11 in the method of manufacturing the superconducting high-frequency acceleration cavity according to the second embodiment. The present embodiment is similar to the second embodiment in other respects.

Figure 17:
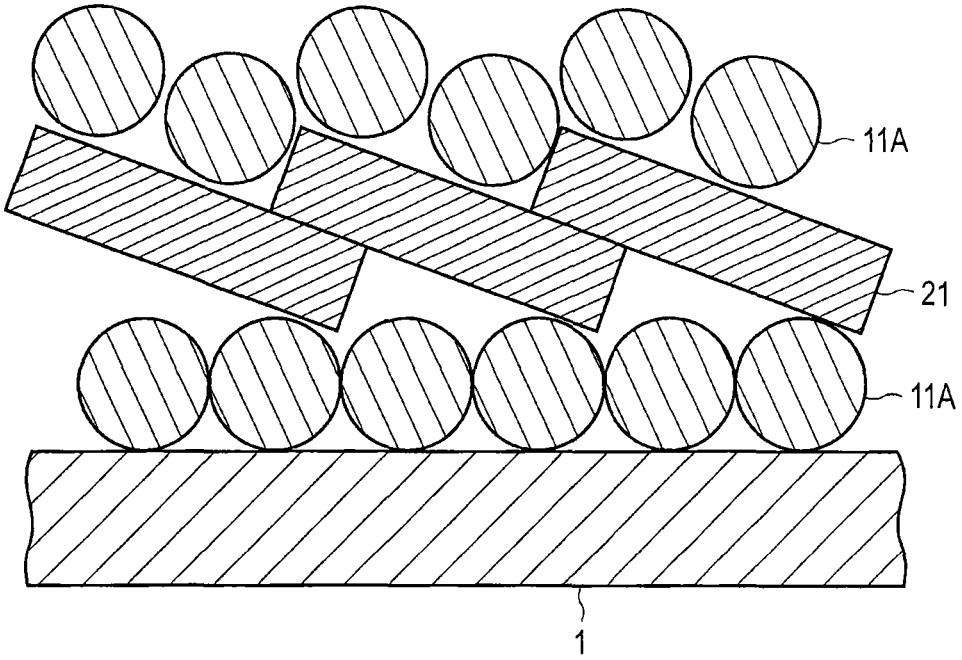
FIG. 17 is a sectional view of the aluminum shaft around which niobium wires and tin thin films according to a ninth embodiment are wound, wherein the upper part of the surface cut in the longitudinal direction is shown.

FIG. 17 is a sectional view of the aluminum shaft 1 around which the niobium wires 11A and the tin thin films 21 are wound, wherein the upper part of the surface cut in the longitudinal direction is shown.

As shown in FIG. 17, the operator winds the niobium wires 11A and the tin thin films 21 around the aluminum shaft 1 alternately over one another.

The niobium wires 11A are first wound around the aluminum shaft 1. In this case, the niobium wires 11A are wound in close contact without any clearance between the adjacent niobium wires 11A.

The tin thin films 21 are then wound over the wound niobium wires 11A laid one step down and slightly over one another without any clearance between the adjacent tin thin films 21.

Furthermore, the niobium wires 11A are wound over the wound tin thin films 21 laid one step down so that the adjacent niobium wires 11A are located in proximity to each other.

The operator thus repeats the winding of the niobium wires 11A and the tin thin films 21. The operator stacks the niobium wires 11A and the tin thin films 21 on the aluminum shaft 1 to reach a thickness of approximately 5 mm.

The niobium wires 11A and the tin thin films 21 wound around the aluminum shaft 1 are HIP-processed, and an Nb3Sn cylinder can thereby be produced.

According to the present embodiment, it is possible to obtain advantageous effects similar to those according to the second embodiment by use of the niobium wires 11A and the tin thin films 21.

Tenth Embodiment

A method of manufacturing a superconducting high-frequency acceleration cavity according to the tenth embodiment is described with reference to FIG. 18.

In the method of manufacturing the superconducting high-frequency acceleration cavity according to the present embodiment, the niobium wires 11A according to the fourth embodiment are used instead of the niobium thin films 11 in the method of manufacturing the superconducting high-frequency acceleration cavity according to the third embodiment. The present embodiment is similar to the third embodiment in other respects.

Figure 18:
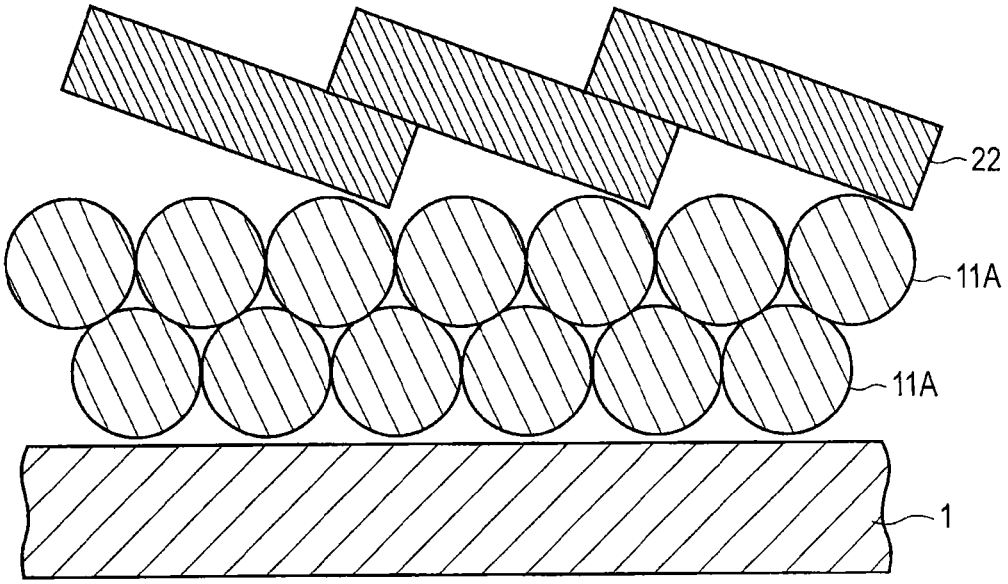
FIG. 18 is a sectional view of the aluminum shaft around which niobium wires and copper thin films according to a tenth embodiment are wound, wherein the upper part of the surface cut in the longitudinal direction is shown.

FIG. 18 is a sectional view of the aluminum shaft 1 around which the niobium wires 11A and the copper thin films 22 are wound, wherein the upper part of the surface cut in the longitudinal direction is shown.

As shown in FIG. 18, the operator first winds the niobium wires 11A around the aluminum shaft 1. In this case, the niobium wires 11A are wound in close contact without any clearance between the adjacent niobium wires 11A. The niobium wire 11A is further wound to pass on the part between the already wound adjacent two niobium wires 11A laid one step down. The operator stacks the niobium wires 11A on the aluminum shaft 1 to reach a thickness of approximately 5 mm.

As shown in FIG. 18, the operator then additionally winds the copper thin films 22 around the aluminum shaft 1 over the wound niobium wires 11A. In this case, the copper thin films 22 are wound slightly over one another without any clearance between the adjacent copper thin films 22. As a result, the copper thin films 22 are wound on the outermost side of the aluminum shaft 1.

The niobium wires 11A and the copper thin films 22 wound around the aluminum shaft 1 are HIP-processed, and a copper-niobium-clad material cylinder can thereby be produced.

According to the present embodiment, it is possible to obtain advantageous effects similar to those according to the third embodiment by use of the niobium wires 11A and the copper thin films 22.

Eleventh Embodiment

A method of manufacturing a superconducting high-frequency acceleration cavity according to the eleventh embodiment is described with reference to FIG. 19.

Figure 19:
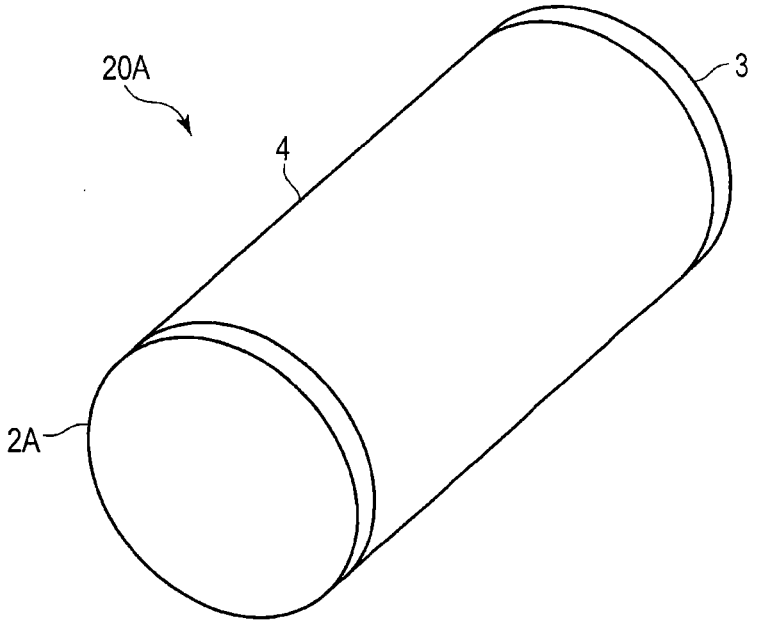
FIG. 19 is a perspective view showing the condition of a work in a process prior to an HIP process according to an eleventh embodiment.

In the method of manufacturing the superconducting high-frequency acceleration cavity according to the present embodiment, the step prior to the HIP process shown in FIG. 5 is replaced by the step prior to the HIP process shown in FIG. 19 in the method of manufacturing the superconducting high-frequency acceleration cavity according to the first embodiment. Other steps are similar to those in the manufacturing method according to the first embodiment.

An aluminum end plate 2A is not provided with the vacuum drawing hole H1 shown in FIG. 5. The aluminum end plate 2A is similar to the aluminum end plate 2 according to the first embodiment in other respects.

The operator inserts, into the aluminum capsule 4, the aluminum shaft 1 around which the niobium thin films 11 are wound. After inserting the aluminum shaft 1 into the aluminum capsule 4, the operator attaches the aluminum end plates 2A and 3 to block both ends of the aluminum capsule 4.

After attaching the aluminum end plates 2A and 3 to the aluminum capsule 4, the operator places, in a vacuum furnace, the aluminum capsule 4 enclosing the aluminum shaft 1 around which the niobium thin films 11 are wound. The operator vacuum-airtight-welds the aluminum capsule 4 having the aluminum end plates 2A and 3 attached thereto in the vacuum furnace by electron beam welding.

The operator HIP-processes the vacuum-airtight-welded aluminum capsule 4 as a work 20A for the HIP process.

According to the present embodiment, the work 20A is vacuum-airtight-welded by electron beam welding, and it is thus possible to obtain advantageous effects similar to those according to the first embodiment.

Twelfth Embodiment

A method of manufacturing a superconducting high-frequency acceleration cavity according to the twelfth embodiment is described with reference to FIG. 20 and FIG. 21.

Figure 20:
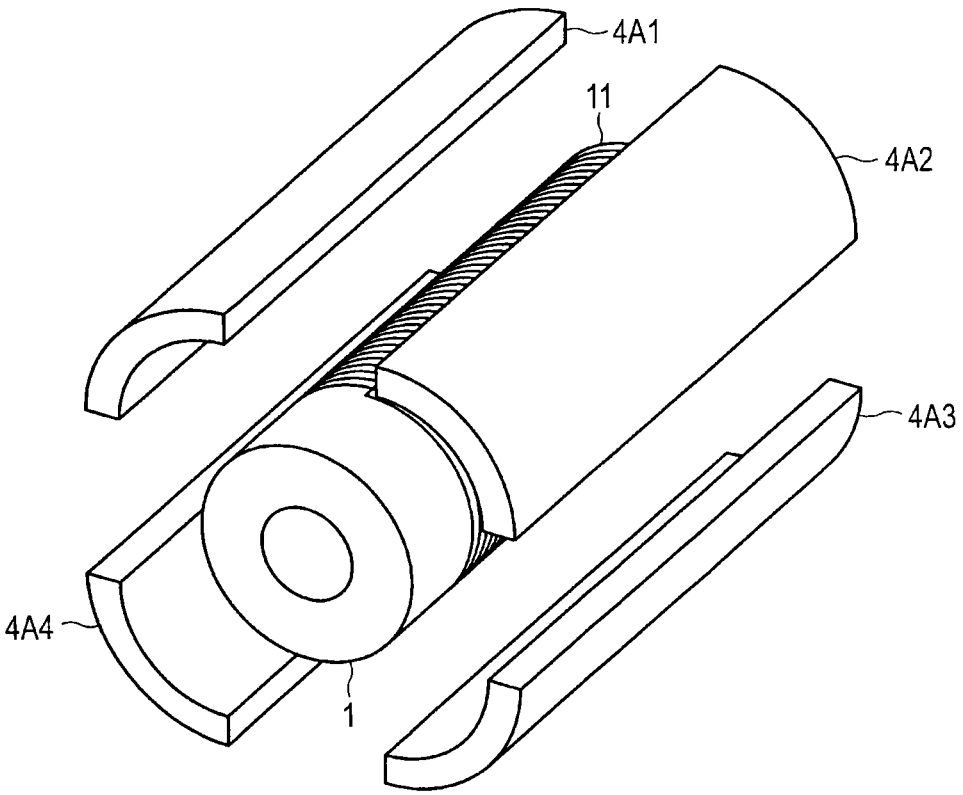
FIG. 20 is a perspective view showing how the aluminum shaft around which niobium thin films according to a twelfth embodiment are wound is covered with aluminum capsules.
Figure 21:
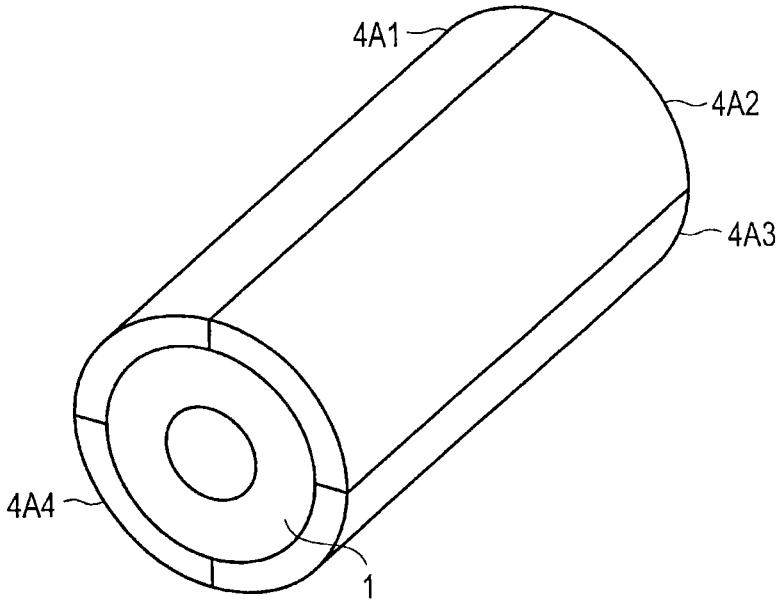
FIG. 21 is a perspective view showing the vacuum-airtight-welded aluminum capsule in a process prior to an HIP process according to the twelfth embodiment.

In the method of manufacturing the superconducting high-frequency acceleration cavity according to the present embodiment, aluminum capsules 4A1, 4A2, 4A3, and 4A4 shown in FIG. 20 and FIG. 21 are used instead of the aluminum capsule 4 shown in FIG. 4 in the method of manufacturing the superconducting high-frequency acceleration cavity according to the first embodiment. Other steps are similar to those in the manufacturing method according to the first embodiment.

The aluminum capsules 4A1 to 4A4 are obtained by longitudinally dividing the aluminum capsule 4 according to the first embodiment into four parts. The aluminum capsules 4A1 to 4A4 are similar to the aluminum capsule 4 in other respects.

As shown in FIG. 20, the operator attaches the aluminum shaft 1 around which the niobium thin films 11 are wound so that the aluminum shaft 1 is covered with the four divided aluminum capsules 4A1 to 4A4. As shown in FIG. 21, the operator vacuum-airtight-welds adjacent four dividing parts of the attached four aluminum capsules 4A1 to 4A4.

According to the present embodiment, it is possible to obtain the following advantageous effects in addition to the advantageous effects according to the first embodiment.

When a superconducting high-frequency acceleration cavity to be manufactured is large in scale (large in diameter or long lengths), a work to be HIP-processed is also large. If the work is large as mentioned above, the aluminum shaft 1 around which the superconducting material is wound is vacuum-airtight-welded in the process prior to the HIP process by using the divided aluminum capsules 4A1 to 4A4. Consequently, it is possible to facilitate the operation of covering with the divided aluminum capsules 4A1 to 4A4.

Thirteenth Embodiment

A method of manufacturing a superconducting high-frequency acceleration cavity according to the thirteenth embodiment is described with reference to FIG. 22 and FIG. 23.

In the method of manufacturing the superconducting high-frequency acceleration cavity according to the present embodiment, a superconducting member (hereinafter referred to as a "cell") in the form of two bowls that are coupled to each other on their sides greater in diameter is formed instead of the cylinder formed in the first embodiment. The manufacturing method according to the present embodiment uses an aluminum pipe 1B, aluminum end plates 2B and 3B, and aluminum capsules 4B1 and 4B2 instead of the aluminum shaft 1, the aluminum end plates 2 and 3, and the aluminum capsule 4 that are used in the first embodiment. The present embodiment is similar to the first embodiment in other respects.

The aluminum pipe 1B has the form of the aluminum shaft 1 according to the first embodiment that is projected in its center. The outer shape of the aluminum pipe 1B substantially corresponds to the inner shape of the cell. The aluminum pipe 1B is similar to the aluminum shaft 1 according to the first embodiment in other respects.

Each of the aluminum capsules 481 and 4B2 is in the form of a bowl having a hole in its side smaller in diameter. The shapes of the inner sides of the aluminum capsules 4B1 and 4B2 that are coupled to each other on their sides greater in diameter substantially correspond to the outer shape of the cell. The aluminum capsules 4B1 and 4B2 are similar to the aluminum capsule 4 according to the first embodiment in other respects.

The aluminum end plates 2B and 3B are shaped suitably to block the holes made in the sides of the aluminum capsules 4B1 and 4B2 smaller in diameter. The aluminum end plates 2B and 3B are similar to the aluminum end plates 2 and 3 according to the first embodiment in other respects.

Figure 22:
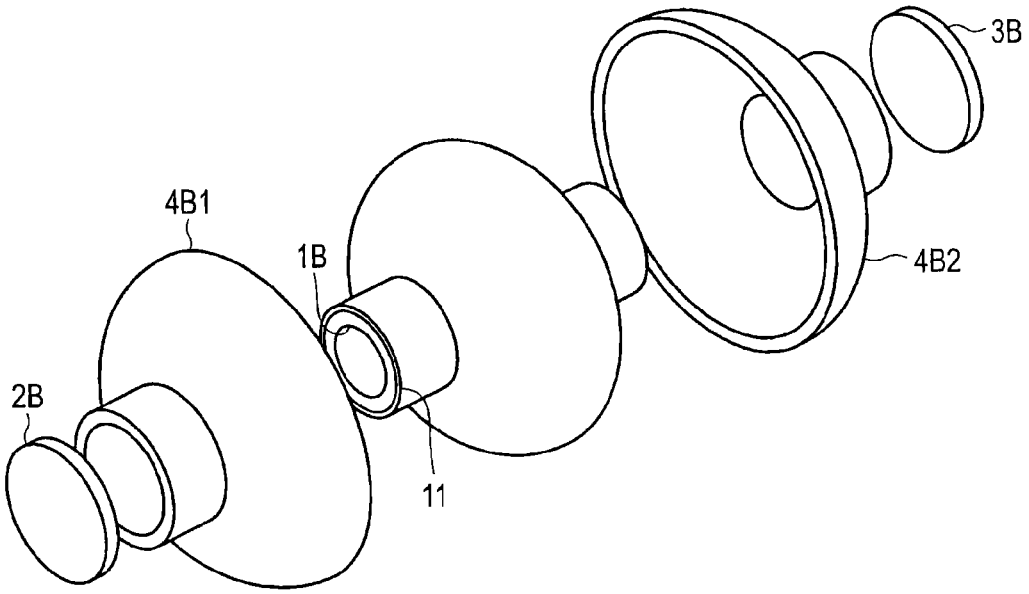
FIG. 22 is a perspective view showing how an aluminum pipe around which niobium thin films according to a thirteenth embodiment are wound is capped with aluminum capsules.
Figure 23:
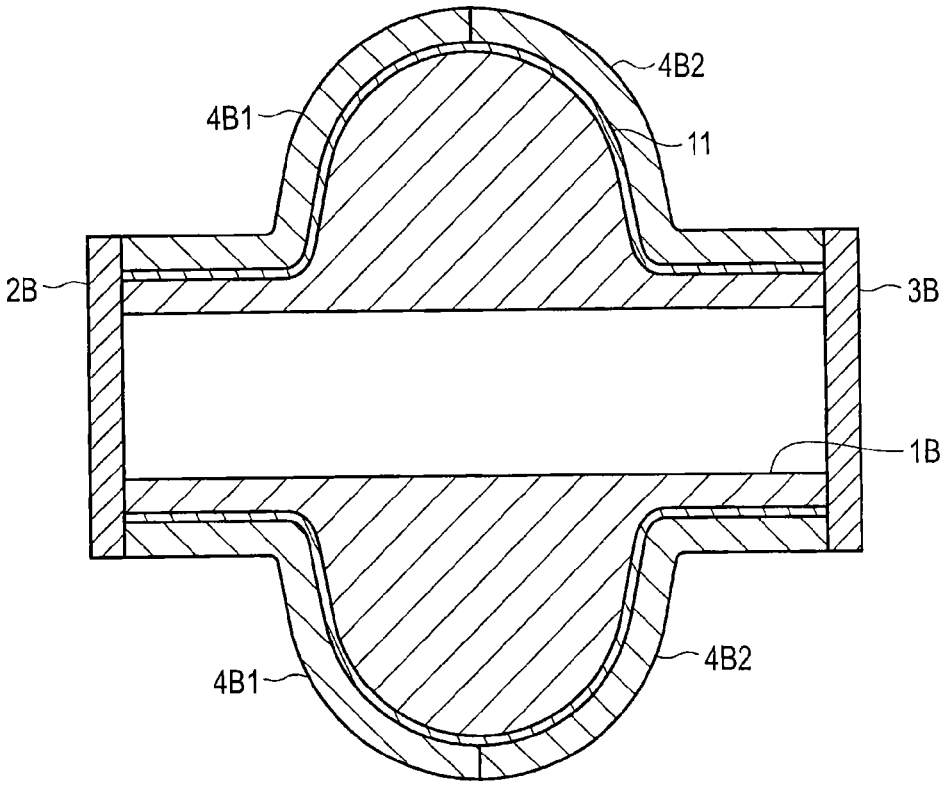
FIG. 23 is a sectional view of vacuum-airtight-welded aluminum capsules according to the thirteenth embodiment, wherein the surface cut in the longitudinal direction is shown.

As shown in FIG. 22, the operator winds the niobium thin films 11 all around the aluminum shaft 1. In this case, there may be some openings in the wound niobium thin films 11.

The operator caps the aluminum pipe 1B around which the niobium thin films 11 are wound with the aluminum capsules 4B1 and 4B2 so that the aluminum pipe 1B is held therebetween. After capping the aluminum pipe 1B around which the niobium thin films 11 are wound with the aluminum capsules 4B1 and 4B2, the operator attaches the aluminum end plates 2B and 3B to block the holes of the aluminum capsules 4B1 and 4B2. With the aluminum end plates 2B and 3B respectively attached to the aluminum capsules 4B1 and 4B2, the operator conducts the vacuum airtight welding. FIG. 23 is a sectional view of the vacuum-airtight-welded aluminum capsules 4B1 and 4B2, wherein the surface cut in the longitudinal direction (the direction of the central axis of the cavity) is shown.

The operator HIP-processes, as a work, the vacuum-airtight-welded aluminum capsules 4B1 and 4B2 enclosing the aluminum pipe 1B around which the niobium thin films 11 are wound. The operator removes the aluminum part on the outer side of the HIP-processed work by machining. The operator takes, out of the work, the niobium-covered aluminum pipe 1B modeled into a cell form. The operator removes, by machining, the aluminum pipe 1B from niobium modeled into a cell form. The operator may immerse the aluminum pipe 1B in a strongly basic solution to dissolve and remove the aluminum pipe 1B. The operator machines and finishes the ends (parts located on the aluminum end plates 2B and 3B) of the taken cell. The operator polishes the cell to approximately submicron surface roughness. The operator uses the manufactured cell as a component to constitute a cavity, thereby manufacturing a superconducting high-frequency acceleration cavity.

The operator uses the manufactured cell to manufacture a superconducting high-frequency acceleration cavity.

According to the present embodiment, advantageous effects similar to those according to the first embodiment can be obtained not only in the manufacture of a cylinder but also in the manufacture of a cell.

Modification of Thirteenth Embodiment

A manufacturing method according to the present embodiment uses a ceramic pipe shaft instead of the aluminum pipe 1B.

When removing the ceramic pipe from niobium modeled into a cell form, the operator smashes this pipe.

According to the present modification, even when it is difficult to remove, after HIP bonding, the pipe from niobium modeled into a cell form, the pipe can be smashed and thereby easily removed.

Although only the cylindrical form or the cell form has been described in each of the embodiments, the form is not limited. Any form having a cavity through which to pass the charged particle beam may be used. For example, it is possible to manufacture an accordion form having a large number of connected cells. In particular, the manufacturing method according to the thirteenth embodiment permits the member inside the cavity provided for the HIP process to be easily removed even in the case of a complex form. Moreover, the member (the aluminum pipe or the aluminum shaft) inside the cavity may be removed by any method, for example, by machining, by smashing, or by immersion and dissolution in the strongly basic solution.

Although the manufacturing methods described in the embodiments use the superconducting material, a normal conducting material may be used instead. Therefore, either a superconducting high-frequency acceleration cavity or a normal conducting high-frequency acceleration cavity may be manufactured in the end.

Furthermore, for convenience of explanation, the manufacturing methods described in the eleventh to thirteenth embodiments are based on the first embodiment in which the niobium thin films 11 are used as the superconducting material. However, the manufacturing methods may be based on the other embodiments.

Although the aluminum capsules 4A1 to 4A4 are divided into four parts in the twelfth embodiment, the aluminum capsules may be divided into any number equal to or more than two. When a cylinder to be manufactured is large in scale (large in diameter or long lengths), the operation of capping with the aluminum capsules is easier if the aluminum capsules are divided into a larger number. If the aluminum capsules are divided into a smaller number, it is possible to reduce divided portions of the aluminum capsules that have to be vacuum-airtight-welded.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. A method of manufacturing a high-frequency acceleration cavity component, the method comprising:

covering a mold with a conducting material;

enclosing, in an outer shell, the mold covered with the conducting material;

vacuum-airtight-welding the outer shell enclosing the mold;

conducing hot isostatic pressing to the vacuum-airtight-welded outer shell; and taking the conducting material covering the mold out of the outer shell which has undergone the hot isostatic pressing.

2. The high-frequency acceleration cavity component manufacturing method according to claim 1, wherein the covering the mold with the conducting material includes winding the conducting material around the mold.

3. The high-frequency acceleration cavity component manufacturing method according to claim 1, wherein the conducting material is a superconducting material.

4. The high-frequency acceleration cavity component manufacturing method according to claim 3, wherein the conducting material comprises niobium.

5. The high-frequency acceleration cavity component manufacturing method according to claim 3, wherein the conducting material comprises tin.

6. The high-frequency acceleration cavity component manufacturing method according to claim 3, wherein the conducting material comprises copper.

7. The high-frequency acceleration cavity component manufacturing method according to claim 1, wherein the mold comprises aluminum.

8. The high-frequency acceleration cavity component manufacturing method according to claim 1, wherein the mold comprises ceramics.

9. The high-frequency acceleration cavity component manufacturing method according to claim 1, further comprising polishing the conducting material covering the mold to submicron order surface roughness.

10. The high-frequency acceleration cavity component manufacturing method according to claim 1, wherein the vacuum-airtight-welding is conducted by electron beam welding.

11. The high-frequency acceleration cavity component manufacturing method according to claim 1, wherein the outer shell is divided before the mold covered with the conducting material is enclosed in the outer shell.

12. The high-frequency acceleration cavity component manufacturing method according to claim 1, wherein the mold is smashed to remove the mold from the conducting material covering the mold.

13. The high-frequency acceleration cavity component manufacturing method according to claim 1, wherein the taking the conducting material covering the mold out of the outer shell includes chemically dissolving to remove the mold.

* * * * *